US009586801B2

(12) United States Patent
Macquet

(10) Patent No.: US 9,586,801 B2
(45) Date of Patent: Mar. 7, 2017

(54) METHOD AND DEVICE FOR PROCESSING CONTAINERS

(75) Inventor: Philippe Macquet, Quimper (FR)

(73) Assignee: HEMA, Quimper (FR)

( * ) Notice: Subject to any disclaimer, the term of this patent is extended or adjusted under 35 U.S.C. 154(b) by 831 days.

(21) Appl. No.: 13/520,374

(22) PCT Filed: Jan. 3, 2011

(86) PCT No.: PCT/EP2011/050039
§ 371 (c)(1),
(2), (4) Date: Jul. 3, 2012

(87) PCT Pub. No.: WO2011/083106
PCT Pub. Date: Jul. 14, 2011

(65) Prior Publication Data

US 2012/0279177 A1 Nov. 8, 2012

(30) Foreign Application Priority Data

Jan. 6, 2010 (FR) ..... 10 50063

(51) Int. Cl.
*B65B 55/02* (2006.01)
*B67C 7/00* (2006.01)
(Continued)

(52) U.S. Cl.
CPC ..... *B67C 7/0073* (2013.01); *B65B 7/2835* (2013.01); *B65B 55/08* (2013.01); *B65D 47/0838* (2013.01)

(58) Field of Classification Search
CPC ..... B65B 7/2835; B65B 55/08; B65B 55/04; B65B 7/2842; B65B 7/2878; B65B 43/38;
(Continued)

(56) References Cited

U.S. PATENT DOCUMENTS 4,494,363 A * 1/1985 Rica ..... B65B 55/022 53/109
4,807,425 A * 2/1989 Abrams ..... 53/468
(Continued)

FOREIGN PATENT DOCUMENTS

CN 200942944 Y 9/2007
CN 101316769 A 12/2008
(Continued)

OTHER PUBLICATIONS

Chinese Office Action issued Oct. 24, 2013.

*Primary Examiner* — Michelle Lopez
*Assistant Examiner* — Chinyere Rushing-Tucker
(74) *Attorney, Agent, or Firm* — Bachman & LaPointe, P.C.

(57) ABSTRACT

A method for processing containers includes, for each container to be processed: a) an assembling step of assembling a cap having a cover on a container, the cap including a tubular base and a cover pivotably connected to the base, between an open position and a closed position, the cap being assembled via the base thereof onto the container at an opening of the container, b) a step of sterilizing the container provided with the cap having a cover, and c) a step of filling the container, the filling step including filling the container with a filling product while the cap having the cover is in the open position, and moving the cover into the closed position.

13 Claims, 5 Drawing Sheets

(51) Int. Cl.
*B65B 7/28* (2006.01)
*B65B 55/08* (2006.01)
*B65D 47/08* (2006.01)

(58) Field of Classification Search
CPC ..... B65B 43/39; B65B 61/005; B65B 31/06; B65B 31/046; B67C 7/0073; B65D 47/0838; B65D 17/501; B65D 17/50; B67B 3/003; B67B 3/22
USPC ..... 53/426, 574, 425, 471, 485; 220/359.4, 220/359.2, 359.1, 810; 215/232
See application file for complete search history.

(56) References Cited

U.S. PATENT DOCUMENTS 4,972,652 A * 11/1990 Critchley ..... B65B 7/2842 53/109
5,860,461 A * 1/1999 Helmut ..... 53/426
6,145,688 A * 11/2000 Smith ..... 220/259.3
6,330,780 B1 * 12/2001 Shipway ..... B65B 55/022 53/268
6,523,330 B1 * 2/2003 Hurd ..... B65B 43/50 53/289
2004/0060261 A1 * 4/2004 Py ..... 53/167
2004/0222224 A1 * 11/2004 Plester ..... 53/167
2008/0073549 A1 * 3/2008 Avnery ..... 250/397
2009/0045350 A1 2/2009 Humele et al.
2010/0224632 A1 9/2010 Aneas
2013/0333796 A1 * 12/2013 Py ..... B65D 51/002 141/1

FOREIGN PATENT DOCUMENTS

CN 101360677 A 2/2009
EP 0101642 A2 2/1984
FR 2953414 A1 6/2011
FR 2954704 A1 7/2011
GB 2389357 A 12/2003
WO 0222460 A1 3/2002
WO 2004007290 A1 1/2004
WO 2004087515 A1 10/2004
WO 2006114697 A2 11/2006

* cited by examiner

METHOD AND DEVICE FOR PROCESSING CONTAINERS

BACKGROUND

This invention relates to a method for processing containers comprising the sterilisation, the filling and the capping of containers, in order to obtain sterilised containers, filled with a sterile filling product and sealed with a cap. This invention further relates to a processing device and a particular cap for the implementation of the method according to the invention.

The conventional filling method, for the filling of a container comprising in particular an upper opening, and in particular a neck, comprises in a first step the sterilisation of the container, its filling with a sterile filling product, then its capping via the setting in place of a sterilised cap. The sterilisation, the filling and the capping are carried out on three different treatment stations, for example on the stations of three different carrousels.

For the sterilisation, it is known, in particular through U.S. Patent 2009/0045350, treatment devices comprising a rotating carrousel comprising a rotating support plate carrying a plurality of treatment stations arranged with regular angular spacing, each treatment station comprising means of sterilising which comprise an electron-beam emitter, and supporting means in order to support a container under said emitter, said emitter being able to emit an electron beam passing through the upper opening of a container supported by said supporting means, in order to sterilise the container, in particular the internal wall of said container. In relation to conventional chemical sterilisation, sterilisation via electron beam is more effective in terms of sterilisation, faster, and does not leave any residual traces after treatment. This type of sterilisation allows for a filling at a high level of sterility.

The filling can be carried out by means of a carrousel of the same type as for the sterilisation, each treatment station comprising means of filling, such as a filling spout or one or several filling tubes, and supporting means to support a container under said filling spout.

The capping can include the screwing of a cap on the neck of the containers. In order to obtain a final product with a substantial level of sterility the cap is more preferably sterilised beforehand with a particular system.

SUMMARY OF THE INVENTION

The purpose of the invention is to propose a new method which makes it possible to obtain a sterile filling of containers with a high level of sterility, which is greater than that obtained via a conventional method of filling.

To this effect, this invention proposes a method for processing containers in order to obtain containers filled with a filling product and sealed with a cap characterised in that it comprises, for each container to be treated, a) an assembling step for the assembly of a cap having a cover on a container, said cap comprising a tubular base and a cover pivotably connected to said base, by means of an articulation, between an open position and a closed position, said cap being assembled via its base on said container on an opening of said container, more preferably on an upper opening of the latter, for example on the neck of a container, b) a step of sterilising the container provided with its cap having a cover, in particular the internal wall of the container, c) a step of filling the container, said step of filling comprising the filling of the container with the filling product, via its opening, with the cover of its cap in open position, and the manoeuvre of the cover to its closed position.

According to the invention, a cap having a cover, also referred to as a cap with flap, is positioned on each container before it is sterilised, with the cover being manoeuvred into open position for the filling of the container, which makes it possible to guarantee a high level of sterility for the filled and sealed container. The cover can furthermore be placed in closed position, between the assembling step of the cap and the step of sterilising, after the step of filling, as well as possibly between the step of sterilising and the step of filling. The use of the cap having a cover makes it possible to have a sealed container during the steps of transferring between various treatment stations. Furthermore, the step of sterilising makes it possible to simultaneously sterilise the inside of the container as well as the surfaces of the cap which will be in contact with the filling product. The method according to the invention is of high performance in terms of the level of sterility, while still remaining simple in design and implementation.

According to a particularity, the step c) of filling is followed by a step d) of fastening, in a sealed manner, of the cover in its closed position on the base. This step of fastening guarantees a perfect seal and as such a good level of sterility after filling. As soon as the filling is complete, the cover is brought to closed position, which guarantees good sterility of the container between the filling and the step of fastening. According to an embodiment, said step d) of fastening is carried out via heat sealing, for example via ultrasound, of the cover on the base.

According to another particularity, the sterilisation in the step b) of sterilisation is carried out by an electron beam generated by an electron-beam emitter when the cover of the cap is in open position.

The use of a cap having a cover according to the invention makes it possible to use containers with a large upper opening while still guaranteeing a good level of sterilisation, this large opening allowing for the easy passage of the antenna of the electron beam emitter. According to an embodiment, said step b) of sterilisation is carried out by an emitter provided with a tubular nozzle able to deliver via its distal end the electron beam created by the emitter, said step of sterilising comprising

- the manoeuvre of the cover towards its open position,
- the introduction of the nozzle into the container, by passing through its opening, and
- the withdrawal of the nozzle outside of the container.

According to another particularity of an embodiment, at least two successive steps among the steps a), b), c) and d) are carried out at different successive treatment stations, the cover of the cap being in closed position between two successive treatment stations.

According to an embodiment, the steps a), b), c) and d) are carried out at different treatment stations, with the cap being in closed position during the transfer of the container from one station to another, the step of sterilising comprising the manoeuvre of the cap towards its closed position at the end of the emission of the electron beam.

According to an embodiment, the manoeuvre of the cover between its two positions is carried out by relative movement, more preferably in vertical translation of an actuating system of a treatment station in relation to the cap, said actuating system able to cooperate with at least one protruding actuating member that is complementary to the cover in order to move the latter between its two positions.

According to an embodiment, the method comprises, after the step of filling, and more preferably after the step d) of fastening, a step of shaving e) of said actuating member.

This invention also has for purpose a cap having a cover, for the implementation of the method described previously, said cap having a cover comprising a tubular base, with which said cap is intended to be assembled on a container, in particular the neck of a container, and a cover pivotably connected to the tubular base, by means of an articulation, around an axis perpendicular to the longitudinal axis of the base, between a closed position and an open position, the base, the cover and the articulation being formed of a one-piece part, made of thermoplastic material for example, said cap having a cover being characterised in that said cover is able to be heat-sealed in closed position on its base.

According to an embodiment, said cover and/or said base has an annular layer of a heat-fusible material for the fastening via heat sealing of the cover on its base.

According to an embodiment, the cap comprises an actuating lever of the cover arranged on the cover on the side of the articulation.

This invention also has for purpose a processing device for the implementation of the method according to the invention, characterised in that it comprises one or several treatment stations for the sterilisation of containers via electron beam and/or the filling of containers with a filling liquid, each treatment station comprising

- means of sterilising which comprise an electron-beam emitter and/or
- means of filling, such as a filling spout or one or several filling tubes, and
- supporting means for supporting a container under said emitter and/or under said means of filling, said emitter being able to emit an electron beam passing through the upper opening of a container supported by said supporting means in order to sterilise said container, in particular the internal wall of the container, said means of filling being able to deliver a determined quantity of filling product in a container, supported by said supporting means, through its upper opening, each station further comprising an actuating system able to cooperate with an actuating member, such as a lever, the cover of a cap having a cover mounted on said container during a relative movement in vertical translation of said actuating system in relation to said container supported by the supporting means for manoeuvring said cover between a closed position of the cover and an open position, said cover being manoeuvred in open position in order to carry out the treatment, i.e. the sterilisation and/or the filling, and is manoeuvred in closed position at the end of said treatment, with the emitter then making it possible to sterilise the surfaces of the cap intended to be in contact with the filling product.

BRIEF DESCRIPTION OF THE DRAWINGS

The invention shall be better understood, and other purposes, details, characteristics and advantages shall appear more clearly during the following detailed explanatory description of a particular currently preferred embodiment of the invention, in reference to the annexed diagrammatical drawings, wherein.

DETAILED DESCRIPTION OF THE PREFERRED EMBODIMENT(S)

Figure 1:
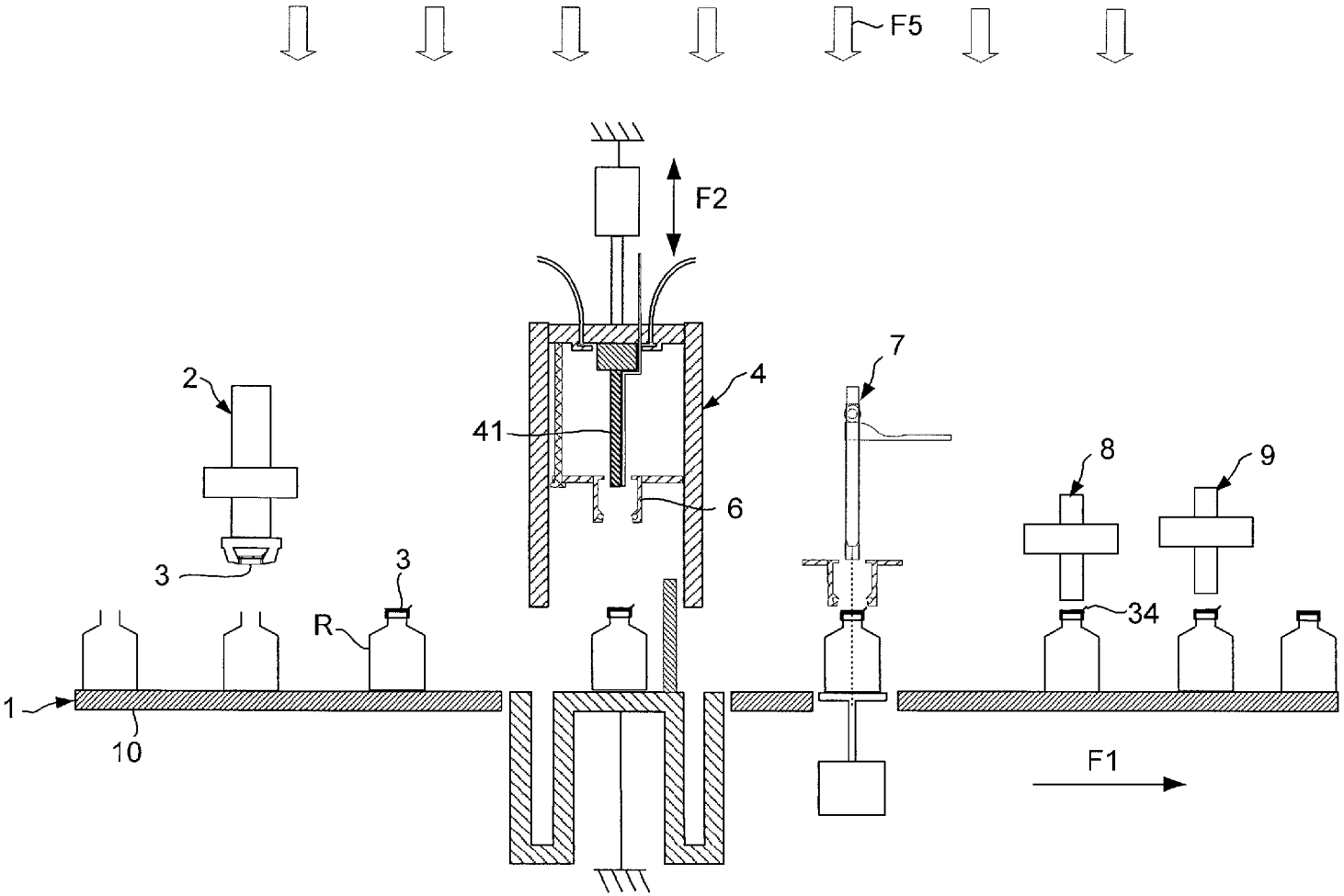
FIG. 1 is a diagrammatical side view of a processing device of containers according to the invention, comprising an assembling station of a cap having a cover, a sterilisation station, a filling station, a heat-sealing station of the cap and a shaving station of the cap.

FIG. 1 shows a processing device for the assembly of a cap having a cover on containers R, the sterilisation of the containers R provided with a cap, the filling of the sterilised containers with a filling product, and the final capping, in a sealed manner, of the containers. The device according to the invention allows for the sterilisation, the filling and the capping of any type of container R comprising an upper main opening, and in particular a neck. The containers can be of the bottle type, such as shown diagrammatically in the figures, made of glass or of plastic material such as PET, PEHD or PP. The containers can also be of carton packaging, for example of oblong shape, preformed and already closed, with in the upper portion a heat-sealed base, whereon is assembled a cap having a cover according to the invention.

The processing device comprises a treatment line 1 comprising a system of conveying 10, with step-by-step operation, along which are arranged from upstream to downstream in relation to the forward direction F1, an assembling station 2 for the assembly of a cap 3 having a cover on the containers, a sterilisation station 4 for the sterilisation of containers, a filling station 7, a welding station 8, and a shaving station 9. The entire treatment line is placed under a laminar flow of sterile air, for example a descending laminar flow, such as presented diagrammatically by the arrows F5.

The assembling station 2 here makes possible the screwing of a cap 3 having a cover on the neck of empty containers, and therefore comprises means of screwing, known per se, for the screwing of a cap.

Figure 2A:
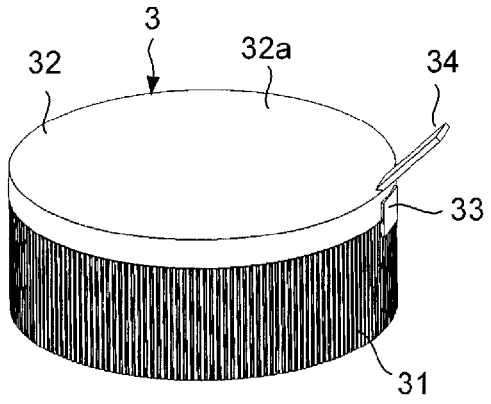
FIG. 2A is a perspective view of a cap having a cover according to the invention, with the cover in closed position.
Figure 2B:
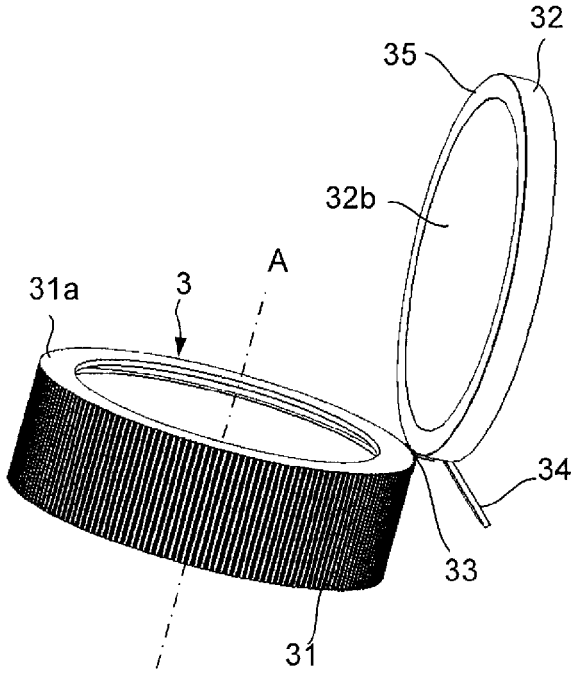
FIG. 2B is perspective view of the cap of FIG. 1, with the cover in open position.

In reference to the FIGS. 2A and 2B, the cap 3 comprises a hollow tubular base 31, of longitudinal axis A, of circular section, and a cover 32 pivotably connected to the tubular base, by means of an articulation 33, between a closed position shown in FIG. 2A and an open position shown in FIG. 2B. The movement of the cover between its two positions is carried out by pivoting around a pivoting axis, defined by the articulation, which is perpendicular to the axis A of the tubular base. The base is assembled on the neck of the container by screwing. The internal wall of the base is provided with ribs allowing for the taking and the screwing of the cap on the neck of a container, this neck being provided with an outside helical threading. Alternatively, the cap is assembled via snap-fitting of its base on the neck of the container.

The articulation 33 is of the film-hinge type, with the base, the cover and the articulation being comprised of a single and part made of plastic material, for example polyethylene or polypropylene.

The cover is formed of a simple circular plate, the outside diameter of the lateral wall of the cover corresponding substantially to the outside diameter of the lateral wall of the base. In closed position, the cover comes via its main lower surface 32*b* against the upper annular edge 31*a* of the base, in such a way as to seal the internal passage of the tubular base, and therefore the upper opening of the container provided with said cap. In open position, the cover is arranged substantially 90° from the base, parallel to the axis A of the latter.

The articulation is advantageously of the film-hinge type with spring effect, known per se, making it possible to assist the closing movement of the cover and/or the opening movement, more preferably the closing movement and the opening movement, the cover being solicited elastically towards its closed position and towards its open position from an unstable position also referred to as "dead centre". In its closed position, the cover is maintained elastically pressing against the base.

The cover is provided with an actuating member intended to cooperate with an additional actuating system, with which the sterilisation station and the filling station are provided, for manoeuvring the cover between its two positions. The actuating member is formed of a lever 34 or prong, arranged on the cover 32, on the side of the articulation. The lever extends from the main upper surface 32*a* substantially at 45°, towards the exterior, beyond the lateral wall of the cover.

The main lower surface 32*b* is provided with an annular layer 35 of a fastening material, via which the cover in closed position comes against the annular edge 31*a* of the base. The fastening material is in particular a heat-fusible material, having for example a melting point less than that of the material comprising the base of the cover and of the articulation. The heat-fusible material is for example a silicone or a polymer product sold under the trade name Surlyn.

Figure 3A:
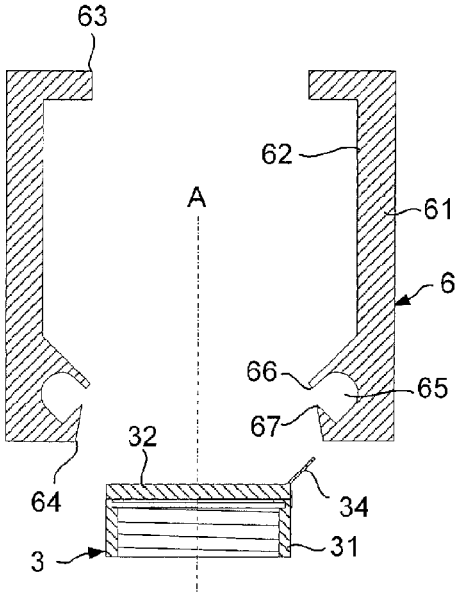
FIGS. 3A to 3E are diagrammatical side views of a cap and of the actuating system of the sterilisation station and of the filling station showing the various positions of the actuating system in relation to the cap for manoeuvring the cover of the cap between its closed position and its open position.

In reference to FIG. 3A, the actuating system 6 comprises a hollow cylindrical part, referred to as an actuating cylinder 61, comprising a central passage 62, an open upper end 63 and an open lower end 64. The internal surface of the actuating cylinder is provided, on the side of its lower end, with an annular groove 65. The groove is defined between a circular upper edge 66 and a circular lower edge 67, the circular upper edge being offset towards the interior in relation to lower edge.

Figure 3B:
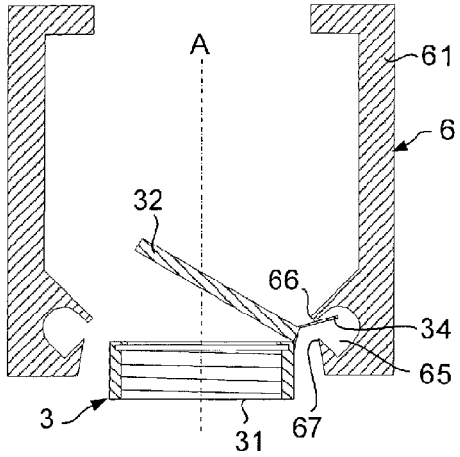

At the sterilisation station or at the filling station, the container provided with the cap 3 with its cover in closed position is arranged under the actuating cylinder 6, such as shown in FIG. 3A, the longitudinal axes of the base and of the actuating cylinder being substantially aligned. In order to open the cover, a relative movement of the actuating cylinder 6 is carried out downwards, in vertical translation. During this movement, the lever 34 passes beyond the lower edge 67, which is retracted in relation to upper edge 66, and the actuating cylinder 6 comes to press via the upper edge 66 against the lever and pivots the cover in order to open it, such as shown in FIG. 3B.

Figure 3C:
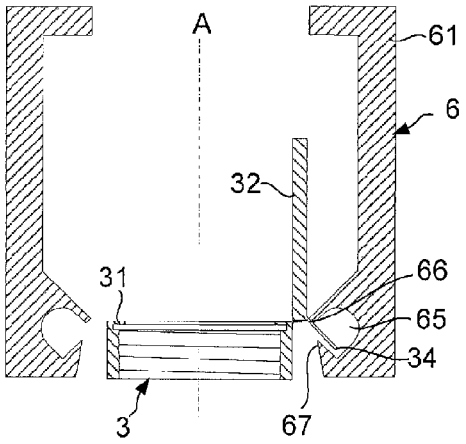
Figure 3D:
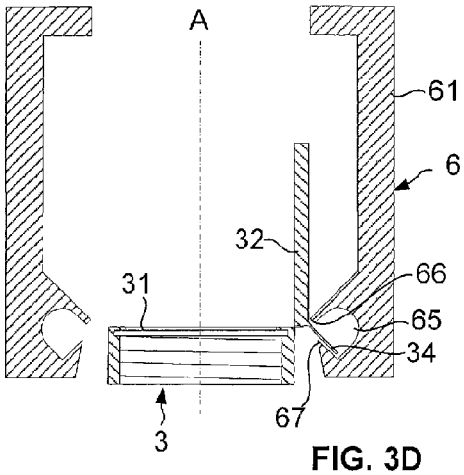

If the hinge is not with spring effect, the actuating cylinder 6 is moved downwards until the position shown in FIG. 3C, in order to bring the cover into open position. Such as described hereinafter, in particular for the filling, the actuating cylinder 6 can be raised slightly such as shown in FIG. 3D, in such a way that the lever is no longer in contact with the cylinder. If the hinge is with spring effect, the cylinder presses on the lever until the dead centre of the cover, for example at 45° of the plane of the opening of the base, then accompanies the movement of the cover, beyond its dead centre, until its open position. The cover is lowered from its position in FIG. 3B only until the position shown in FIG. 3D.

In this open position, the operations of sterilisation and of filling can be carried out.

Figure 3E:
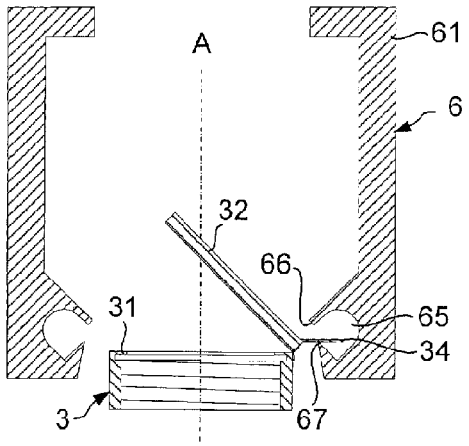

For the closing of the cover, the actuating cylinder is raised from its position in FIG. 3D until its position in FIG. 3A. During this raising, the lower edge 67 presses on the lever and pivots the cover 32 towards its closing position, such as shown in FIG. 3E.

The sterilisation station 4 makes possible the sterilisation of the interior wall of the containers and of the cap, by passing through the upper opening of the containers. The sterilisation station is for example similar to that described in French patent application 0959655, filed on 29 Dec. 2009 by the applicant. In reference to FIG. 4A, the sterilisation station 4 comprises means of sterilising formed of an electron-beam emitter 41, known per se, provided with a tubular nozzle or tubular antenna 411, of extended form, the emitter being able to deliver an electron beam by the distal end of its nozzle. The means of sterilising are for example formed of an emitter, such as described in U.S. Patent 2008/0073549. The emitter is mounted fixed on the lower surface of a small plate or plate 42 referred to as upper, its nozzle, of vertical longitudinal axis B, extending vertically downwards. The nozzle is defined in such a way that it can be inserted via the upper opening of containers provided with caps with their cover in open position, so as to irradiate the interior of the containers. The plate support is mounted mobile on the chassis of the device, by the intermediary of moving means 43, also referred to as means of raising/lowering, known per se, making it possible to move the upper plate in vertical translation, such as shown by the arrow F2, between a high retracted position, and low operative positions described hereinafter.

Each sterilisation station further comprises supporting means for a container R for the maintaining of a container under the emitter, substantially centred according to the axis B of the nozzle. The supporting means include a harness or lower plate 44, mounted fixed on the chassis of the device.

The device according to the invention comprises a protection system or shielding for stopping the radiation emitted by the emitters, in particular the interference radiation of the X ray type. This system of shielding comprises an upper portion and a lower portion. The upper portion has the form of a bell formed by the upper plate 42 and an upper tubular wall 45, also referred to as an upper skirt, extending downwards from said upper plate. The upper plate constitutes the bottom wall of the bell, the upper skirt 45 surrounds the emitter 41 and its antenna 411 and extends beyond the distal end of the antenna. The lower portion is formed by said lower plate 44 and by a lower tubular wall 46, also referred to as a lower skirt, extending downwards from said lower plate 44. Alternatively, the means of movement act on the supporting means, with the bell being mounted fixed on the chassis.

The sterilisation station is furthermore provided with an actuating cylinder 6, such as described previously. The actuating system is mounted mobile in the bell, on the upper plate 42. The actuating cylinder is mounted slidingly on at least one vertical guide rod 47, more preferably at least two guide rods, fixed on the upper plate and extending in the bell parallel to the upper skirt. The actuating cylinder 6 is provided with a collar at its upper opening, with the rod passing in a hole of said collar 68 and being provided at its free end with a stop 47*a*. The lower plate 44 is provided with a vertical spacer or bar 48 serving as a stop for the actuating cylinder.

Figures 4A, 4B, 4C, 4D, 4E:
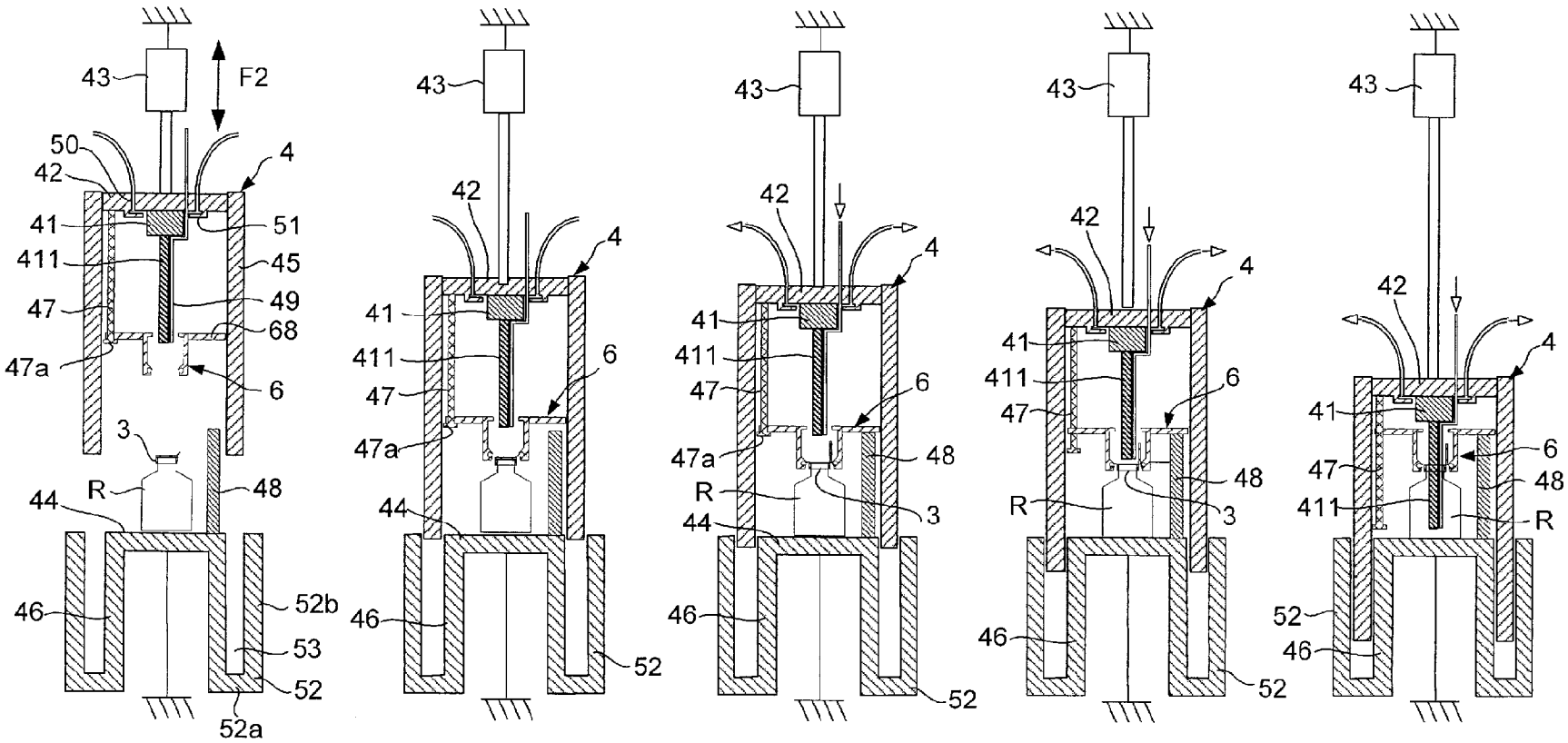
FIGS. 4A to 4E are side views of the sterilisation station showing the various positions of the protection system, of the emitter, of the actuating system and of the cover during the sterilisation of a container; and, FIGS. 5A to 5D are side views of the filling station showing the various positions of the filling tube, of the actuating system and of the cover during the filling of a container.

In reference to FIG. 4A, in the high retracted position of the upper plate, the annular free edge of the bell is arranged above the lower plate, in such a way that a container R can be brought on said lower plate, under the emitter and under the bell. The actuating cylinder is abutted against the stop 47*a*. The distal end of the nozzle is for example arranged in the actuating cylinder, above the upper edge 66.

For the sterilisation operation of a container, the upper plate 42 is moved in vertical translation downwards, via the moving means 43, towards a first operative position, shown in FIG. 4C. During this movement, the actuating cylinder comes against the lever of the cap, such as shown in FIG. 4B, and moves the cover towards its open position. In the first operative position in FIG. 4C, the actuating cylinder is in the position shown in FIG. 3C, and is pressing via its collar 68 against the stop 47*a* and against the free end of the spacer 48. The bell comes to cover the container R, the lower skirt 46 of the lower portion sliding in the upper skirt 45 of the bell. The emitter 41 and its antenna 411 are arranged above the opening of the container. The upper plate 42 and the upper skirt 45 forming the bell, as well as the lower plate 44 provided with its lower skirt 46, are made of a lead base, and together form in this first operative position a protective enclosure E. In this first operative position, the emitter 41 can be activated in order to irradiate the external wall of the container and the cap. The upper skirt 45 and the lower skirt overlap over a height that is sufficient to prevent the radiation from exiting the enclosure E.

The upper plate 4 is then moved further downwards, via the moving means 43, until the extreme operative position shown in FIG. 4E, in order to irradiate the entire internal wall of the container. During this movement, the lower skirt 46 of the lower portion slides in the upper skirt 45 of the bell. The length of the nozzle 411 and the height of the upper skirt 45 are adapted, in such a way that the distal end of the nozzle is arranged in the vicinity of the bottom of the container R in the extreme operative position.

Moreover, during this movement, the collar 68 abutted against the spacer slides along the guide rod 47, in such a way that the actuating cylinder retains the same position in relation to the container, in order to maintain the cover of the cap in open position. FIG. 4D shows an intermediate position of the plate between the first operative position and the extreme position.

The upper plate 42 is then brought back progressively towards its first operative position shown in FIG. 4C. The irradiation is then stopped, and the upper plate 4 is brought back to its retracted position shown in FIG. 4A. During this movement the cover is brought by the actuating cylinder in its closed position. The conveyor 10 is then activated to evacuate the treated container and transfer it to the filling station, and in order to bring a new container to be treated under the emitter.

The sterilisation station more preferably comprises means of injecting for the injection of a product into the enclosure, in order to expel the ozone generated during the sterilisation via electron beam, and means of evacuating for the evacuation of gas outside of the enclosure. The station comprises an injection tube or tubing 49 mounted fixed in the bell. This tube extends parallel to the antenna of the emitter, with the distal end of the tube arranged substantially at the same level as the distal end of the antenna. This tube passes through the upper plate 42 of the bell in a substantially sealed manner. The tube is used to inject into the container R a neutral gas, such as nitrogen, immediately after the irradiation, for example when the upper plate 4 is in its first operative position, in order to create an overpressure in the container R and as such expulse outside of the container the ozone generated by the irradiation. Alternatively, the injection of neutral gas is also carried out during the irradiation, for example when the upper plate is moved from its extreme operative position towards its first operative position. Alternatively, the tube is used to deliver liquid nitrogen into the container R, for example one drop of liquid nitrogen, during and/or just after the irradiation, with the liquid nitrogen changing to gaseous phase then progressively filling the container and progressively flushing the ozone outside of the container.

The upper plate is provided with vent holes 50 emerging into the enclosure E in order to prevent an overpressure inside the enclosure. These vent holes are used to evacuate the gas which is contained in the enclosure and which is compressed during the descent of the upper plate until its extreme operative position. Moreover, these vent holes are used to evacuate the ozone generated in the container by the irradiation and pushed to the outside of the container R by the nitrogen injected. A system of baffles 51, made of lead, is provided on the lower surface of the upper plate in order to act as a screen to the X rays generated during the irradiation, and as such avoid any propagation of radiation outside of the enclosure by said vent holes. The vent holes are connected to flexible pipes, placed in a vacuum, in order to suck the gas compressed by the relative movement of the bell and of the lower portion, and in particular the ozone generated by the irradiation.

Advantageously, a system of baffles 52, also made of lead, is provided in order to prevent any propagation of radiation at the interface between the upper portion and the lower portion of the protection system, more precisely at the interface between the upper tubular wall 45 of the bell, and the lower tubular wall 46. The system of baffles 52 comprises a horizontal annular edge 52*a* extending towards the exterior from the free edge of the lower tubular wall 46, and extending via a vertical annular wall 52*b*, which extends upwards parallel to the lower tubular wall, substantially until the lower plate 44. This annular wall 52*b* forms with the lower tubular wall 46 an annular housing 53 wherein slides the upper tubular wall 45 of the bell during the relative movement of the bell in relation to lower plate 44.

Figure 5A:
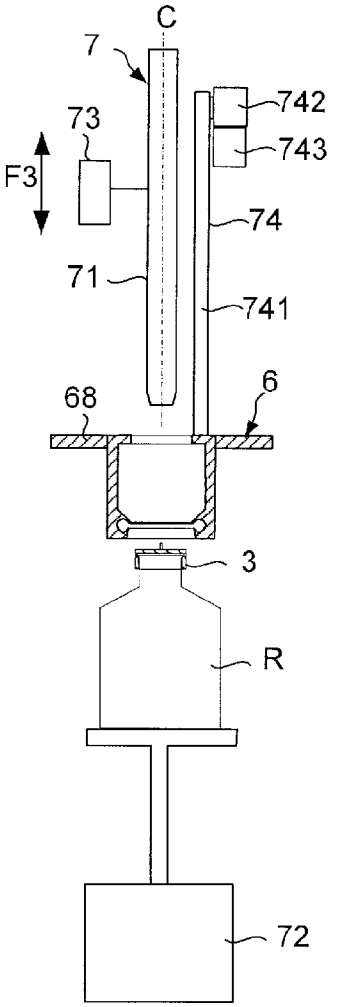
Figure 5B:
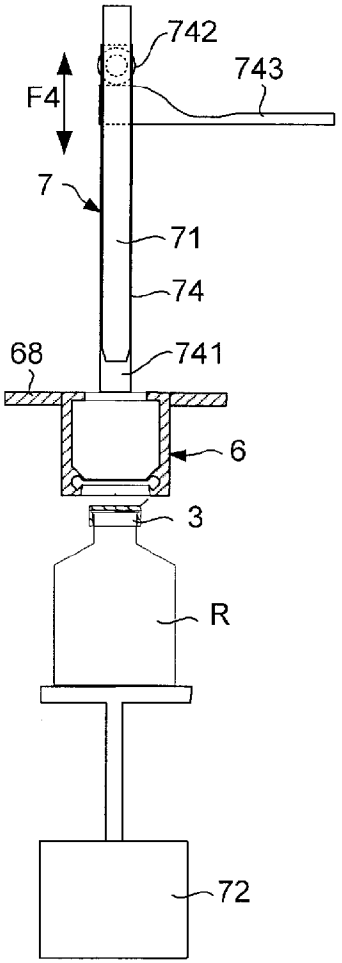

The filling station for example of the weight-based type, allows for the filling of sterilised containers with a determined quantity of filling product, the filling product being liquid or viscous, for example a liquid product such as water, milk or fruit juice. FIGS. 5A and 5B are two diagrammatical side views, at 90° from one another, of the filling station. The filling station 7 comprises means of filling comprising a filling tube 71, of axis C, and supporting means 72 in order to support a container provided with a cap having a cover under said filling tube. First moving means 73 make possible a relative movement in vertical translation of the tube in relation to the means of support, such as shown by arrow F3, between a high position wherein the tube is arranged above the container, and a low position wherein the tube penetrates into the container. In the embodiment shown, said first moving means 73 act on said tube, with the supporting means being mounted fixed on the chassis of the device.

The filling station is also provided with an actuating cylinder 6 allowing for the opening of the cover just before the filling and the closing of the cover just after the filling. The actuating cylinder, centred according to the axis C of the tube, is mounted mobile on the chassis of the device via second moving means 74. The actuating cylinder is provided with a control rod 741, mounted on the collar and provided at its free end with a roller which cooperates with a mechanical cam 743 to move in vertical translation the cylinder, such as shown by the arrow F4, between a high position shown in FIGS. 5A and 5B, wherein the actuating cylinder 42 is arranged above the cap of a container supported by the supporting means 72, and a low position shown in FIG. 5C, corresponding to the position in FIG. 3C.

Figure 5C:
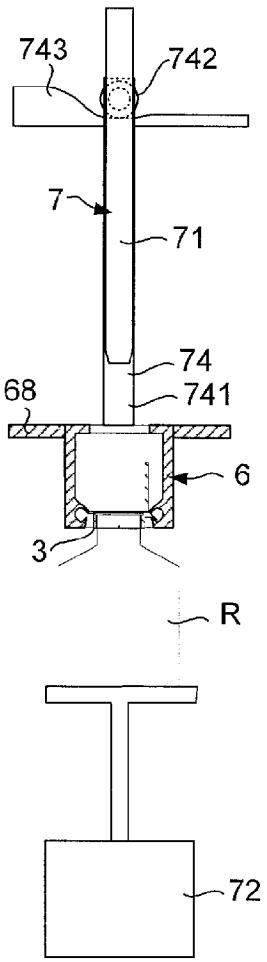
Figure 5D:
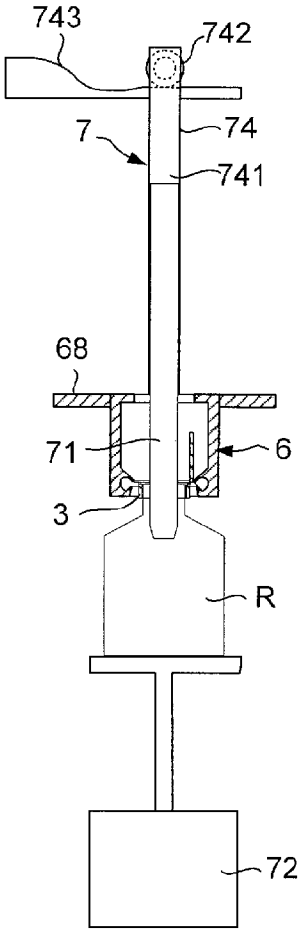

The cylinder can be moved upwards from its low position to an intermediate low position shown in FIG. 3D, corresponding to the position shown in FIG. 5D, wherein the lever is no longer in contact with the cylinder. This intermediate low position is particularly advantageous in the case of a weight-based dosage for the filling of containers.

In the case of caps provided with hinges which are with spring effect with regards to the opening, the second moving means 74 can be provided to pass directly from the high position to the intermediate low position in FIG. 5D, without passing through the low position in FIG. 5C. In this open position of the cover, the tube, which is in high position, above the cover, can be moved in its low position in order to carry out the operation of filling. At the issue of the filling, the tube is moved to high position, then the cylinder can be moved to high position in order to return the cover to closed position.

The heat-sealing station 8 comprises means of heating to heat the fastening material of the cap when the cover is in closed position, in order to thermo-seal the cover and the base. The heat-sealing station comprises for example means of sealing via ultrasound, in order to minimise the heating of the plastic material comprising the cap.

The shaving station 9 makes it possible to cut the lever 34 at its base, the lever being for example trimmed via rotation of the container against a sharp flat blade, mounted fixed on the chassis of the device.

The treatment of a container by the device according to the invention is as follows. The empty container is transferred to the assembling station 2 where a cap with its cover in closed position is assembled by screwing on the neck of the container. The container is then transferred with its cover in closed position to the sterilisation station 4. At the sterilisation station, the upper plate 42 is displaced in order to manoeuvre the cover into open position via the actuating cylinder, introduce the nozzle 411 of the emitter into the container, then remove the nozzle from the container, and manoeuvre the cover to its closed position.

The sterilised container with the cover in closed position is then transferred to the filling station 7 where the actuating cylinder 6 of said station and the tube 71 are moved via their respective means of movement to manoeuvre the cover to its open position, introduce the tube into the container for the filling, remove the tube from the container then manoeuvre the cover to its closed position. The container is then transferred with its cover in closed position to the heat-sealing station 8 for the final closing of the cap, by thermo-sealing the cover on the base, then the container is transferred to the shaving station 9 for withdrawal of the lever 44.

The cover is as such closed again just after the operation of sterilisation, opened just before the operation of filling and closed again just after the operation of filling, which prevents any possible contamination of the interior of the container on sterilisation station and of the filling station. During the transfer of the container from the sterilisation station to the filling station, then from the filling station to the heat-sealing station, the cover is in closed position which prevents any possible contamination during these two phases of transfer. The device according to the invention as such allows for the sterile filling of different containers at a very high level of sterilisation, of a magnitude of Log 6.

The use of a cap having a cover according to the invention makes it possible to use containers with a large upper opening, allowing the filling station the passage of two filling tubes in the container. According to an embodiment, the container is filled by means of two parallel tubes which are inserted into the container and which are used to deliver different products. A first tube is used to deliver for example a liquid, such as a fruit juice, with the other tube being used to deliver pulp and/or vitamins for example.

The device of the linear type described in reference to the figures can of course include several parallel treatment lines, each treatment line comprising one or several assembling stations, sterilisation stations, filling stations, heat-sealing stations and shaving stations.

The processing device according to the invention can also be of the rotating type, the processing device comprising a first carrousel or turret in order to carry out the assembly of the cap, in particular the screwing of the cap, a second carrousel in order to carry out the sterilisation, a third carrousel in order to carry out the filling of said sterilised containers with a filling product, a fourth carrousel for the thermo-sealing, and a fifth carrousel in order to carry out the shaving of the lever. Systems for transferring, for example of the transfer starwheel type, are provided between two successive carrousels for the transfer of the containers.

The sterilisation carrousel comprises a support plate or upper plate, in the form of an annular or circular plate, intended to be mounted rotating about a fixed frame around a vertical axis of rotation. The support plate carries a plurality of treatment stations arranged with regular angular spacing around the axis of rotation. Each station comprises an emitter mounted on the lower surface of the plate. The upper portion of the protection system is comprised of the support plate and a plurality of upper skirts surrounding the emitters and extending from the lower surface of the plate. Each upper skirt forms with the upper plate a bell associated with a treatment station. Each station comprises an actuating cylinder mounted in the bell such as described previously. The supporting means of each treatment station include a harness or lower plate provided with a lower skirt and a spacer used as a stop for the actuating cylinder. Each treatment station comprises means for movement acting this time on the lower plate in order to move between a separated position of the upper plate in order to allow for the positioning of a container on the lower plate and the withdrawal of a container from the lower plate, for example by means of an infeed starwheel and of a delivery starwheel, and operative positions, such as described previously, wherein the lower plate with its upper skirt forms with the upper bell a protective enclosure.

The filling carrousel is of the same type as the sterilisation carrousel, it comprises a rotating support plate supporting a plurality of treatment stations arranged with regular angular spacing, each treatment station comprising means of filling comprising a filling spout or one or several filling tubes, an actuating cylinder, and supporting means for supporting a container under said filling spout.

Moreover, according to another embodiment, the processing device comprises a sterilisation carrousel of the type described in French patent application 0958648 filed on Mar. 12, 2009, of which the protection system comprises a chute. According to another embodiment, the processing device comprises a carrousel of which the treatment stations include both means of sterilising and means of filling, such as described in French patent application 0958647, filed on Mar. 12, 2009 by the applicant.

According to an embodiment, the sterilisation is realised from the outside of the container, for example via gamma radiation, with the cover of the cap in closed position.

According to an alternative embodiment, the cap does not include an annular layer of heat-fusible material, the cover is heat-sealed directly on the base, for example via ultrasound.

Although the invention has been described in liaison with a particular embodiment, it is of course obvious that is not limited to this in any way and that is comprises all of the technical equivalents of the means described as well as their combinations if the latter fall within the scope of the invention.

The invention claimed is:

1. Method for processing containers comprising, for each container to be treated, a) an assembling step for assembling a cap with a cover on a container, said cap comprising a tubular base and a cover pivotably connected to said base by means of an articulation between an open position and a closed position, said cap being assembled via said base on said container on an opening of said container, b) a step of sterilizing the container equipped with said cap having said cover, and c) a step of filling the container, said step of filling comprising maneuvering the cover into open position, filling of the container with a filling product, with the cover of said cap in said open position, and maneuvering the cover towards said closed position, wherein the maneuvering of the cover between the cover's two positions is carried out by relative movement of an actuating system in relation to the cap, said actuating system able to cooperate with at least one actuating member complementary to the cover in order to move the cover between said two positions, wherein said actuating member comprises an actuating lever extending from a main upper surface of the cover adjacent to the articulation, in order to maneuver said cover between said closed position of the cover and said open position.

2. Method of processing according to claim 1, wherein the step c) of filling is followed by a step d) of fastening, in a sealed manner, of the cover in said closed position on the base.

3. Method of processing according to claim 2, wherein said step d) of fastening is carried out via heat sealing of the cover on the base.

4. The method of processing according to claim 3, wherein in step d) of fastening, the cover is heat-sealed via ultrasound onto said base.

5. Method of processing according to claim 2, wherein at least two successive steps among the steps a), b), c) and d) are carried out at different successive treatment stations, with the cover of the cap being in said closed position between two successive treatment stations.

6. Method of processing according to claim 5, the steps a), b), c) and d) are carried out at different treatment stations, with the cap being in said closed position during transfer of the container from one station to another station and, the step of sterilizing comprising maneuvering of the cap towards said closed position at an end of the emission of the electron beam.

7. Method of processing according to claim 1, wherein the step b) of sterilization is carried out by an electron beam generated by an electron beam emitter when the cover of the cap is in said open position.

8. Method of processing according to claim 7, wherein said step b) of sterilizing is carried out by an emitter provided with a tubular nozzle able to deliver via a distal end the electron beam created by the emitter, and said step of sterilizing further comprising maneuvering the cover towards said open position, the introduction of the nozzle into the container, and withdrawal of the nozzle outside of the container.

9. Method of processing according to claim 1, wherein after the step of filling, a step of shaving e) of said actuating member.

10. The method of processing according to claim 1, wherein the cover can be placed in closed position between the assembling step a) and the step of sterilizing b), after the step of filling c), and/or between the step of sterilizing b) and the step of filling c).

11. A method for processing containers comprising, for each container to be treated, a) an assembling step for assembling a cap with a cover on a container, said cap comprising a tubular base and a cover pivotably connected to said base by means of an articulation between an open position and a closed position, said cap being assembled via said base on said container on an opening of said container, b) a step of sterilizing the container equipped with said cap having said cover, and c) a step of filling the container, said step of filling comprising maneuvering the cover into open position, filling of the container with a filling product, with the cover of said cap in said open position, and maneuvering the cover towards said closed position, wherein the maneuvering of the cover between the cover's two positions is carried out by relative movement of an actuating system in relation to the cap, said actuating system able to cooperate with at least one actuating member complementary to the cover in order to move the cover between said two positions, wherein said actuating system comprising a hollow cylindrical part, referred to as an actuating cylinder, comprising a central passage, an open upper end and an open lower end, the internal surface of the actuating cylinder being provided, on the side of its lower end, with an annular groove defined between a circular upper edge and a circular lower edge, the circular upper edge being offset towards the interior in relation to the lower edge, wherein at steps b) and/or c) before maneuvering of the cover the method comprises providing the container provided with the cap with said cover in closed position and arranging said container under said actuating cylinder, the longitudinal axes of said base and of said actuating cylinder being aligned, and wherein the manoeuvring of the cover is carried out by:

for opening the cover, carrying out downwards a relative movement of the actuating cylinder in vertical translation, such that the lever passes beyond the lower edge, which is retracted in relation to the upper edge, and the actuating cylinder comes into a lower position to press via the upper edge against the lever and pivots the cover in order to open it, and for closing the cover, raising the actuating cylinder from said lower position, such that said lower edge presses on a lever and pivots the cover towards its closing position.

12. Method of processing according to claim 11, wherein the step b) of sterilisation is carried out by an electron beam generated by an electron beam emitter when the cover of the cap is in open position, said step b) comprising:

passing an extended formed tubular nozzle of the emitter through the upper opening of the containers, the emitter being able to deliver an electron beam by the distal end of said nozzle, which extends downward, moving a protective bell in vertical translation downwards, via moving means, said bell comprising an upper skirt extending downwards and surrounding the emitter and said nozzle, the emitter being mounted on the bottom wall of said bell, this movement being carried out such that the bell covers the container, a lower skirt of a lower portion supporting the container sliding in the upper skirt of said bell, the bell and the lower portion forming a protection system or shielding for stopping the radiation emitted by the emitters, moving the actuating cylinder by moving said bell such that the actuating cylinder comes against the lever of the cap and moves the cover towards its open position, the actuating system being mounted in the bell, activating the emitter in order to irradiate, bringing back progressively the bell towards a retracted position, during this movement the cover being brought by the actuating cylinder in its closed position.

13. The method of processing according to claim 11, wherein the cover can be placed in closed position between the assembling step a) and the step of sterilizing b), after the step of filling c), and/or between the step of sterilizing b) and the step of filling c).

* * * * *